US011761739B2

(12) United States Patent
Pedicini et al.

(10) Patent No.: US 11,761,739 B2
(45) Date of Patent: Sep. 19, 2023

(54) PROJECTILE CONSTRUCTION, LAUNCHER, AND LAUNCHER ACCESSORY

(71) Applicant: NL Enterprises, LLC, Cheyenne, WY (US)

(72) Inventors: Christopher Pedicini, Nashville, TN (US); Joshua Pedicini, Nashville, TN (US)

(73) Assignee: NL Enterprises, LLC, Sheridan, WY (US)

( * ) Notice: Subject to any disclaimer, the term of this patent is extended or adjusted under 35 U.S.C. 154(b) by 0 days.

(21) Appl. No.: 17/319,295

(22) Filed: May 13, 2021

(65) Prior Publication Data

US 2022/0090894 A1 Mar. 24, 2022

Related U.S. Application Data

(63) Continuation-in-part of application No. 17/027,588, filed on Sep. 21, 2020, now abandoned, and a continuation-in-part of application No. 17/026,249, filed on Sep. 20, 2020, now Pat. No. 11,156,443.

(60) Provisional application No. 63/107,242, filed on Oct. 29, 2020.

(51) Int. Cl.

| | |
|---|---|
| ***F42B 12/50*** | (2006.01) |
| ***F41B 6/00*** | (2006.01) |
| ***F42C 11/00*** | (2006.01) |
| ***F42B 12/36*** | (2006.01) |

(52) U.S. Cl.

CPC ..... *F42B 12/50* (2013.01); *F41B 6/003* (2013.01); *F42B 12/367* (2013.01); *F42C 11/001* (2013.01)

(58) Field of Classification Search

CPC ..... F42B 12/50; F42B 6/003; F42B 12/367; F42B 6/00; F42B 12/46; F42B 12/40; F42C 11/001; F42C 9/00; F42C 11/065; F42C 17/04

See application file for complete search history.

(56) References Cited

U.S. PATENT DOCUMENTS

| | | | | |
|---|---|---|---|---|
| 1,739,921 | A * | 12/1929 | Schuler | F42C 11/04 102/209 |
| 3,958,510 | A * | 5/1976 | Stutzle | F42C 17/04 102/209 |
| 6,557,450 | B1 * | 5/2003 | Cox | F42C 17/04 89/6 |
| 8,305,071 | B2 * | 11/2012 | Frick | F41A 21/32 73/167 |
| 8,746,119 | B2 * | 6/2014 | Frick | F41G 9/00 89/6 |
| 8,985,000 | B2 * | 3/2015 | Frick | F42C 11/008 102/209 |

(Continued)

*Primary Examiner* — Reginald S Tillman, Jr.

(74) *Attorney, Agent, or Firm* — Aidenbaum Schloff and Bloom PLLC; Jay Schloff

(57) ABSTRACT

A launcher and projectile system include at least one magnet disposed on or within the launcher for charging a wire coil of the projectile to energize the projectile, thereafter having a housing of the projectile rupture, disintegrate, separate or otherwise have an opening created therein after launch to release a payload. In another embodiment, an accessory for a launcher and projectile is provided, the accessory comprising a magnet for charging a projectile that is launched by the launcher. The strength of magnetic field of the magnet may be adjusted for selective performance of the projectile.

1 Claim, 10 Drawing Sheets

(56) References Cited

U.S. PATENT DOCUMENTS

| | | | | |
|---|---|---|---|---|
| 9,423,226 | B2 * | 8/2016 | Cillaut | F42B 12/62 |
| 9,528,794 | B2 * | 12/2016 | Franklin | F41A 23/16 |
| 10,976,129 | B1 * | 4/2021 | Timpson | F41B 6/003 |

* cited by examiner

PROJECTILE CONSTRUCTION, LAUNCHER, AND LAUNCHER ACCESSORY

CROSS-REFERENCE TO RELATED APPLICATIONS

The present disclosure is a continuation-in-part of and claims priority under 35 U.S.C. § 120 on pending U.S. Non-provisional application Ser. No. 17/026,249, filed on Sep. 20, 2020 and on pending U.S. Non-provisional application Ser. No. 17/027,588, filed on Sep. 21, 2020, the disclosures of which are incorporated by reference. The present disclosure also claims priority under 35 U.S.C. § 119 on U.S. Provisional Application Ser. No. 63/107,242 filed on Oct. 29, 2020, the disclosure of which is incorporated by reference.

FIELD OF THE DISCLOSURE

The present disclosure relates to non-lethal and lethal projectiles and related launching mechanisms and accessories and more specifically, to those projectiles with an energy storage means that may be charged by a launcher and/or a launcher accessory.

BACKGROUND OF THE DISCLOSURE

Non-lethal projectiles and non-lethal launching systems are commonly used by law enforcement for purposes of crowd control, such as quelling a riot or angry mob or to individually subdue a suspect. Increasingly, they may find usage as another means to augment self-defense in situations such as a home invasion, for example. The projectiles and systems (such as weapons that are capable of delivering such non-lethal projectiles) are designed to subdue a target subject or subjects for a time without causing permanent harm. Typically, such weapons systems require a projectile to burst on impact with the suspect and thus require accurate targeting and, in some cases, cause severe injury to a suspect. The most common means for such a device is a projectile that bursts on impact or a targeting device tethered by wires which delivers a high voltage shock thus immobilizing the suspect. All of these existing means suffer from a number of disadvantages outlined in more detail below.

The use of high voltage electric shock has been around for a number of years. While it is fairly effective at immobilizing a suspect, it suffers from the drawbacks that cardiac arrest in the target/suspect may result due to the voltage imparted into the suspect's body. Additionally, in the case of a suspect who is not in an open or unconstrained environment, such means requires accurate targeting to ensure that the electrodes contact the individual in order to deliver the electric shock. Furthermore, the longest effective range for such a device is less than 30 feet and more typically 10 or 15 feet. Additionally, the effectiveness of such weapons can be inhibited by clothing, coats or wet environments.

A second technique involves the use of a paintball that is filled with a *capsicum* or PAVA powder. While this eliminates or improves on the range issues of the electric shock techniques, it requires accurate targeting of the suspect. This is extremely difficult to do in short range as the ricochet of the powder off of a suspect can cause it to come back to the user. Furthermore, upon impact, the control of the powder release is not necessarily effective and can be one dimensional, meaning that it has difficulty stopping a suspect who is running away—as the cloud is left behind. Additionally, if the impact does not burst the projectile, the intended effect is not achieved.

Another approach is to provide for a projectile, the rupture or separation of which is caused by components that are powered by a battery or batteries that is/are internal to the projectile. However, in that batteries are inherently respectively large and heavy when compared to a projectile, and therefore limit the potential configurations of the projectile (due at least to the fact that the batteries occupy a substantial amount of space within the projectile). Furthermore, batteries are relatively expensive, thereby driving up the cost of manufacture of such a projectile. Furthermore, and quite concerningly, batteries drain and lose charge over time, which means that a projectile so configured may not be in a usable state for firing if it has been on the shelf for a length of time. This drawback is not acceptable, as the conditions under which such projectiles are to be used requires that they be ready to fire at all times.

Lethal projectiles have also been developed that fragment into multiple pieces, thus increasing the effective radius of such a projectile (and lowering the requisite targeting precision). Such fragmentation may be caused by components that are powered by a battery or batteries that is/are internal to the projectile or by the actual impact on the target. However, in that batteries are inherently respectively large and heavy when compared to a projectile, and therefore limit the potential configurations of the projectile (due at least to the fact that the batteries occupy a substantial amount of space within the projectile). Furthermore, batteries are relatively expensive, thereby driving up the cost of manufacture of such a projectile. Moreover, and quite concerningly, batteries drain and lose charge over time, which means that a projectile so configured may not be in a usable state for firing if it has been on the shelf for a length of time. This drawback is not acceptable, as the conditions under which such projectiles are to be used requires that they be ready to fire at all times.

All of the currently available methods for non-lethal projectiles suffer from one or more of the following disadvantages: difficult to target, not suitable for close range, not suitable for long range, inaccurate, sometimes lethal and often otherwise not effective, costly to manufacture, complex in configuration, and not reliably powered. Furthermore, with regard to lethal projectiles, most currently available methods drawbacks the requirement that such a projectile must impact the target to be effective and heavy and complex battery arrangements for power and operation.

SUMMARY OF THE DISCLOSURE

In view of the foregoing disadvantages inherent in the prior art, the general purpose of the present disclosure is to provide a projectile construction (also referred to herein as "projectile" in context), projectile launcher, and launcher accessory that include all the advantages of the prior art, and overcomes the drawbacks inherent therein. As used herein, "payload" may refer to a substance, object, compound, or material that is capable of delivering a lethal or incapacitating force to and/or resulting in a lethal or incapacitating effect upon a target. Such a payload can be in powder, liquid or aerosol, or foam form and/or in the form of shrapnel (or a combination thereof) without departing from the spirit of the disclosure. The payload may comprise a debilitating material, a visible substance (such as a dye or a powder, for example) or an invisible marking substance (such as a UV-reactive material, for example) or a combination thereof. The projectile may also comprise an energy storage means. As used herein, "energy storage means" is a storage means that lacks sufficient energy (such as a charge, for example) to activate or arm the projectile or another component of the projectile until the energy storage means has been energized or re-energized by an outside source (such as a launcher or an accessory thereof). The minimum energy to activate or arm the projectile (or to imitate a reaction as described elsewhere herein) is referred to as the "threshold energy", meaning that at energy levels below the threshold energy, the projectile will not be armed or activated and/or cannot initiate a mechanical or chemical reaction. In an embodiment, the energy storage means comprises a capacitor, which capacitor may be charged or energized by the launcher or launcher accessory prior to or coincident with launching of the projectile.

In an embodiment, a launcher comprises at least one magnet. The at least one magnet may be disposed within or in proximity to the barrel of the launcher, and in a further embodiment, proximate to the point of projectile exit, and in any event along the launch axis of the projectile. (See FIG. 1, for example). The at least one magnet is preferably magnetically-aligned with the launch axis. In an embodiment, the projectile comprises at least one coil of wire. When the projectile is launched, the at least one magnet of the launcher causes a rapid change in magnetic flux of coil of the moving projectile as it moves along the launch axis. This rapid change causes a current to be induced through the coil of the projectile, causing an inductive energy to be produced. In this way, it is understood that the at least one magnet of the launcher is capable of providing energy to the projectile. Those familiar in the art will recognize this as Faraday's Law of Induction $$\left(\varepsilon = -N\frac{d\Phi_B}{dt}\right).$$

That is, electrical energy can be generated thereby from the change in magnetic flux as the projectile moves through the magnetic field caused by the at least one magnet of the launcher. As used herein, this inductive energizing method shall be referred to as "inductive charging" when it is refers to charging an energy storage means and "inductive activation" when it refers to activating a circuit and/or initiator.

In another embodiment, an accessory for a launcher comprises at least one magnet. The accessory is configured to be removably attached to a launcher, and in an embodiment, to the barrel of a launcher. The at least one magnet of the accessory may be disposed within or in proximity to the barrel of the launcher, and along the launch axis of the projectile. (See FIG. 7, for example). The at least one magnet is preferably magnetically-aligned with the launch axis. As used herein, magnetic alignment comprises the creation of magnetic flux lines in the barrel or accessory such that a coil moving through the barrel or accessory receives an induced electrical charge. In an embodiment, the projectile comprises at least one coil of wire. When the projectile is launched, the at least one magnet of the launcher accessory causes a rapid change in magnetic flux of coil of the moving projectile as it moves along the launch axis. This rapid change causes a current to be induced through the coil of the projectile, causing an inductive energy to be produced. In this way, it is understood that the at least one magnet of the launcher accessory is capable of providing energy to the projectile.

In an embodiment, the at least one magnet may be a permanent magnet and/or an electromagnet. In an embodiment, an electromagnet can produce a stationary magnetic field or a time-varying magnetic field (such as by varying alternating current frequency through the electromagnet). In another embodiment, the at least one magnet comprises an electromagnet along with a permanent magnet. In an embodiment, the electric current and/or its frequency provided to the electromagnet can be adjusted such that the induced EMF in the projectile can vary. This variance can be used to vary the distance at which a projectile releases a payload and/or the initiator or control circuit is activated.

A rangefinder may be provided for the launcher and/or launcher accessory, which rangefinder may be operatively coupled to the launcher and/or accessory and, in an embodiment, to the at least one magnet such that the magnetic field strength may be adjusted depending on at least the range to a target or a distance measured by the rangefinder, for example.

In an embodiment, the projectile separates into two or more components after it leaves the barrel of a launcher to distribute a payload. In an embodiment, the separation can be initiated by electrical, mechanical or chemical means or by a combination thereof. In a still further embodiment, the time of initiation can be varied depending on the distance to the suspect or target.

In another embodiment, an electrical circuit may be disposed within the projectile. In said embodiment, the projectile may comprise an energy storage means. The electrical circuit may either initiate a chemical reaction or otherwise cause a separation of the projectile through an electromechanical method, and the circuit may be activated by inductive activation. The release may be timed such that the separation and distribution of the payload is in proximity of the target. The timing may include calculations based on the projectile velocity as well as the distance to the target. The electrical circuit and reaction can be initiated when the energy storage means has been sufficiently charged, i.e., beyond the threshold energy—such charging being done by the launcher or outside source (such as, but not necessarily limited to, the launcher accessory), for example.

In a still further embodiment, the electrical circuit can be activated by a motion sensing switch such as an accelerometer, vibration sensor, or the like at launch of the projectile.

In a still further embodiment in which the separation, opening, etc. of the projectiles is a result of a chemical reaction, an activating compound such as nitrocellulose may be initiated with an "electric match". The electric match may consist of a nichrome or similar high resistance wire that is coated with a pyrogen and is initiated with electrical energy such as from a battery, capacitor, or the like. In an embodiment, wherein the launcher and/or launcher accessory comprises at least one magnet, when the projectile is launched, the at least one magnet of the launcher and/or accessory can activate the electric match by inductive activation.

In a still further embodiment, the projectile launcher (and/or launcher accessory) and the projectile are part of a system in which the projectile is encoded with timing and or distance information as a result of range to target. The projectile launcher and/or launcher accessory may further include a range finder or other means for measuring distance to a target. The launcher (and/or launcher accessory) and projectile can be configured to be in wired or wireless communication with each other, and the launcher and/or launcher accessory may also be capable of transferring energy to the projectile. In an embodiment, the launch of the projectile by the launcher can be accomplished by compressed air, in which embodiment the requirement for complex firing mechanism (such as a primer on the projectile or a hammer for the launcher) is eliminated. However, it will be apparent that the projectile and launcher herein may be configured to be launched by combustion or other means.

DESCRIPTION OF THE DRAWINGS

The advantages and features of the present disclosure will become better understood with reference to the following detailed description and claims taken in conjunction with the accompanying drawings, wherein like elements are identified with like symbols, and in which:

DETAILED DESCRIPTION OF THE DISCLOSURE

The exemplary embodiments described herein detail for illustrative purposes are subject to many variations in structure and design. It should be emphasized, however, that the present disclosure is not limited to a particular projectile or projectile launcher as shown and described. That is, it is understood that various omissions and substitutions of equivalents are contemplated as circumstances may suggest or render expedient, but these are intended to cover the application or implementation without departing from the spirit or scope of the claims of the present disclosure. The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present disclosure provides for a projectile 100 and a launcher 1000, and, in an embodiment, a launcher accessory 1100. The projectile 100 preferably comprises a payload 200 for immobilizing and/or marking a target or suspect. It will be understood that payload as used herein may also comprise a substance, object, compound, or material that is capable of delivering a lethal or incapacitating force to and/or resulting in a lethal or incapacitating effect upon a target The projectile 100 preferably comprises an enclosure, which enclosure may be formed by an at least partially annular-shaped shell 102. The shell may include a closed, substantially planar end portion 104 (also referred to herein as "end cap") that corresponds to a radius of the annular portion of the shell to form the enclosure. The shell and end portion may individually and collectively refer to herein as a housing of projectile 100. It will be apparent that the projectile housing is not limited to the shell and end portion configuration mentioned in the preceding exemplary embodiment, and that the projectile housing may comprise any shape that forms an enclosure without deviating from the spirit of the disclosure, such as, but not necessarily limited to a sphere or a cone. The payload 200 is preferably contained in the enclosure prior to launch of the projectile 100.

In an embodiment, the projectile 100 is capable of self-separating, disintegrating or otherwise opening prior to impact with a target or other impact surface. In an embodiment, the launcher 1000 is capable of initiating separation or disintegration or rupturing or opening, etc. of the projectile 100. In an embodiment, the launcher 1000 is capable of communicating to the projectile 100 and or arming a projectile 100 prior to or coincident with projectile launch. In another embodiment, the launcher comprises a safety and/or trigger, which safety and/or trigger, until activated, prevent the projectile from becoming armed. The arming can be, for example, the charging of an energy storage element or means contained within the projectile.

Figure 1:
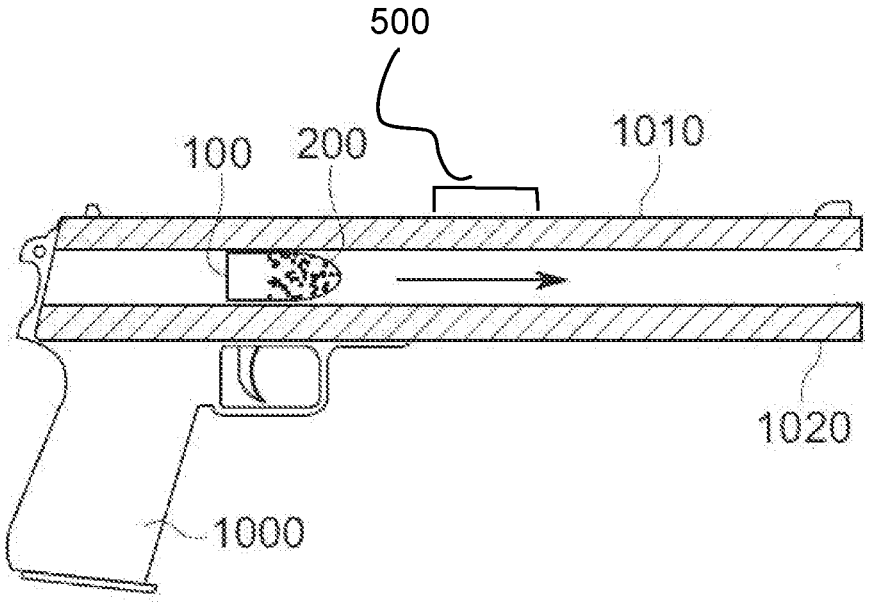
FIG. 1 is a longitudinal cross-sectional view of a projectile launcher 1000 with a projectile, according to an exemplary embodiment of the present disclosure.
Figure 1A:
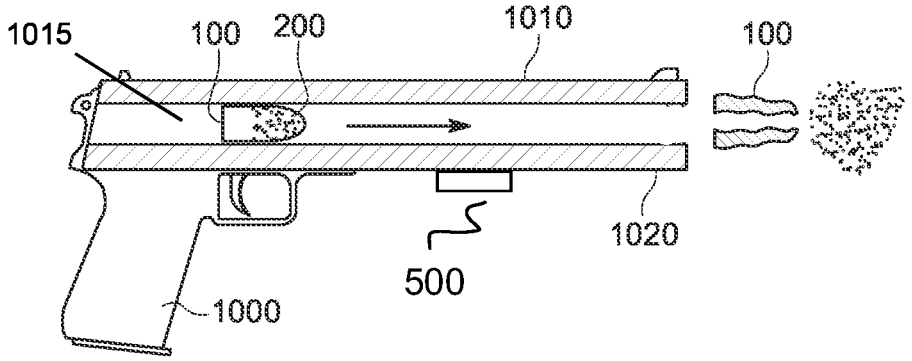
FIG. 1A is a view of the barrel of a projectile launcher and at least one magnet of the launcher.
Figure 2:
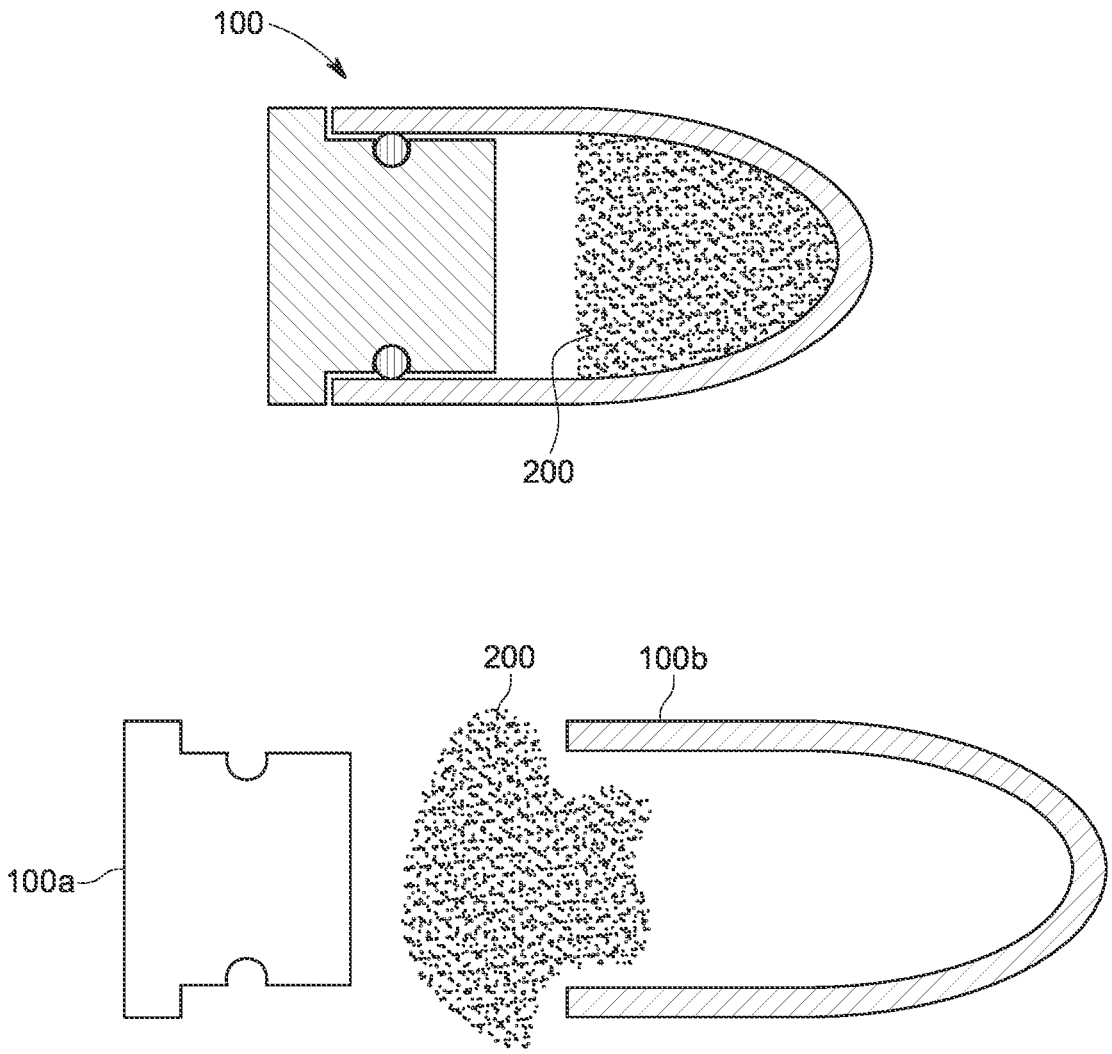
FIG. 2 are views of a projectile both before launch and then during flight in which the housing of the projectile has separated and released a payload, in accordance with an exemplary embodiment of the present disclosure.

In another embodiment and as shown in FIG. 1A, the launcher comprises at least one magnet 500. The at least one magnet 500 may be disposed within or in proximity to the barrel of the launcher, and in a further embodiment, proximate to the point of projectile exit, and in any event along the launch axis of the projectile. (See FIG. 1, for example). The at least one magnet 500 is preferably magnetically-aligned with the launch axis. In a further embodiment, a launcher accessory 1100 comprises at least one magnet 1500 (see FIG. 7, for example). The launcher accessory may be removably attachable to a launcher 1000, and the at least one magnet 1500 of the accessory may be disposed along the launch axis of the projectile that is to be launched by the launcher.

Figure 6:
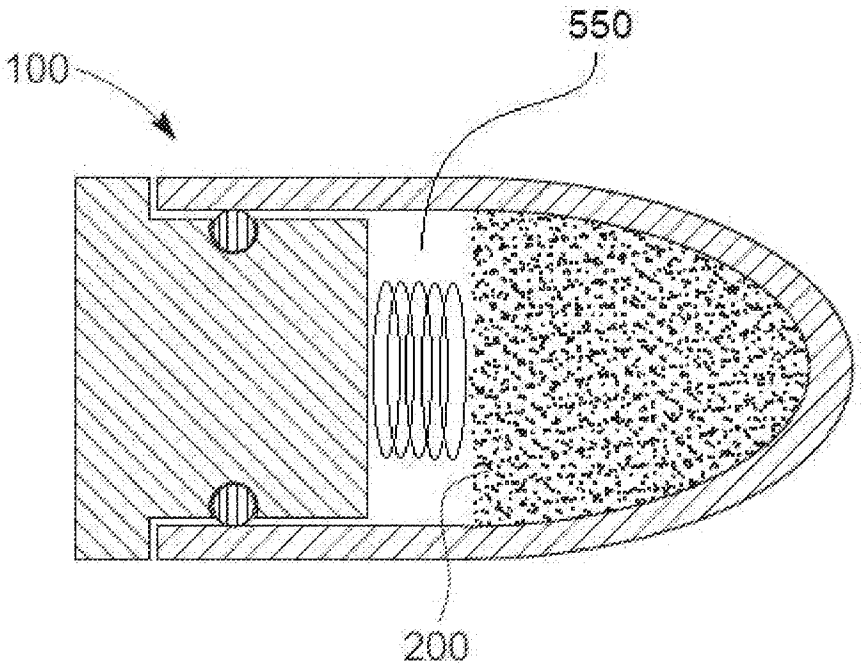
FIG. 6 shows a cross-sectional view of a projectile comprising a coil of conductive wire in accordance with an exemplary embodiment of the present disclosure.

In an embodiment, and as shown in an exemplary embodiment in FIG. 6, the projectile comprises at least one coil of wire 550. When the projectile is launched, the at least one magnet 500 of the launcher and/or the at least one magnet 1500 of the launcher accessory 1100 causes a rapid change in magnetic flux of coil 550 of the moving projectile. This rapid change causes a current to be induced through the coil 550 of the projectile, causing an inductive energy to be produced. The resultant energy can be used to cause an initiator or electrical circuit (described elsewhere herein) to be activated, for example. That is, electrical energy can be generated in this embodiment from the change in magnetic flux as the projectile moves through the magnetic field caused by the at least one magnet 500 and/or 1500.

An exemplary launcher 1000 is shown in FIG. 1A. The launcher comprises a barrel 1010 for directing and launching a projectile 100. The launcher 1000 may also comprise a chamber 1015 for holding a projectile prior to firing thereof. It will be apparent that the launcher 1000 shown in FIG. 1*a* may be in other configurations so long as the launcher 1000 is capable of firing a projectile 100 of the projectiles disclosed herein.

In an embodiment, the projectile 100 housing opens or otherwise separates after it leaves the barrel 1010 of a launcher 1000 to distribute a payload. That is, the rupturing or breaching of the projectile housing or the separation of housing components creates an opening in the projectile 100 out of which the payload 200 may emanate.

In another embodiment the projectiles 100 disclosed herein include various means of adjustment of the aforementioned embodiments in which the release or dispersion of the payload 200 occurs at fixed or predetermined distances from the barrel 1010 of the launcher 1000 and/or launcher accessory 1100. Selective release may also be achieved by adjusting the strength of the electromagnetic field of the at least one magnet 500 or 1500 that induces a charge in the projectile. Such adjustment may be made by a power source (such as a battery) that is disposed within the launcher 1000 or accessory 1100. The power source itself may be adjustable to provide for various amounts of power to the electromagnet and adjustment of the strength of the field. In an embodiment, the power source is in communication with the magnet via an alternating current signal, and the strength of the magnetic field is controllable by varying the power and/or the frequency of the signal.

In another embodiment, the release may be accomplished by a control circuit 120. Such a control circuit 120 may include a radio-frequency identification (RFID), where an RFID tag in the projectile 100 may cause the projectile 100 to rupture at a user-specified distance from the launcher 1000 or launcher accessory 1100. Said rupturing may be caused by initiating a reaction with nitrocellulose for example. In such an embodiment, it will be apparent that the launcher 1000 and launcher accessory 1500 may comprise a transmitter or other means for communicating with the RFID tag or the reaction may be controlled by other means. In another embodiment, the control circuit is inductively activated.

Figure 3:
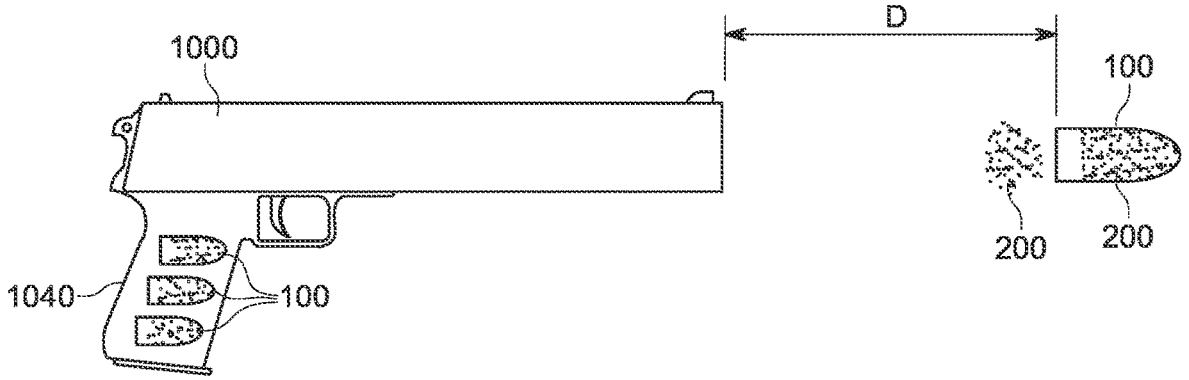
FIG. 3 is a view of a projectile launcher with a magazine in which the projectiles are set to rupture at various times/distances after launch, in accordance with an exemplary embodiment of the present disclosure.

As shown in FIG. 3, the launcher and projectile system may comprise a magazine 1040 that holds a plurality of projectiles 100 and that feeds said projectiles 100 to the launcher 1000 for firing/launching the projectiles 100. In an embodiment, the various projectiles 100 of the magazine 1040 may be configured to separate or rupture, etc. at the same distance "D" or time after launch, or they may be configured to separate or rupture, etc. at different distances and/or times after launch. In the embodiment where the various projectiles are configured to separate or rupture, etc. at the same distance "D" or time after launch, it will be apparent that a user may concentrate the effect of the payload from the ruptured projectiles within a certain defined area. In an embodiment where the various projectiles are configured to separate or rupture, etc. at different distances and/or time after launch, it will be apparent that the particular distance and/or time after launch at which the separation, etc. of each particular projectile of the various projectiles may be accomplished by selectively setting the separation, etc. of each projectile of the various projectiles as elsewhere set forth herein.

Figure 4:
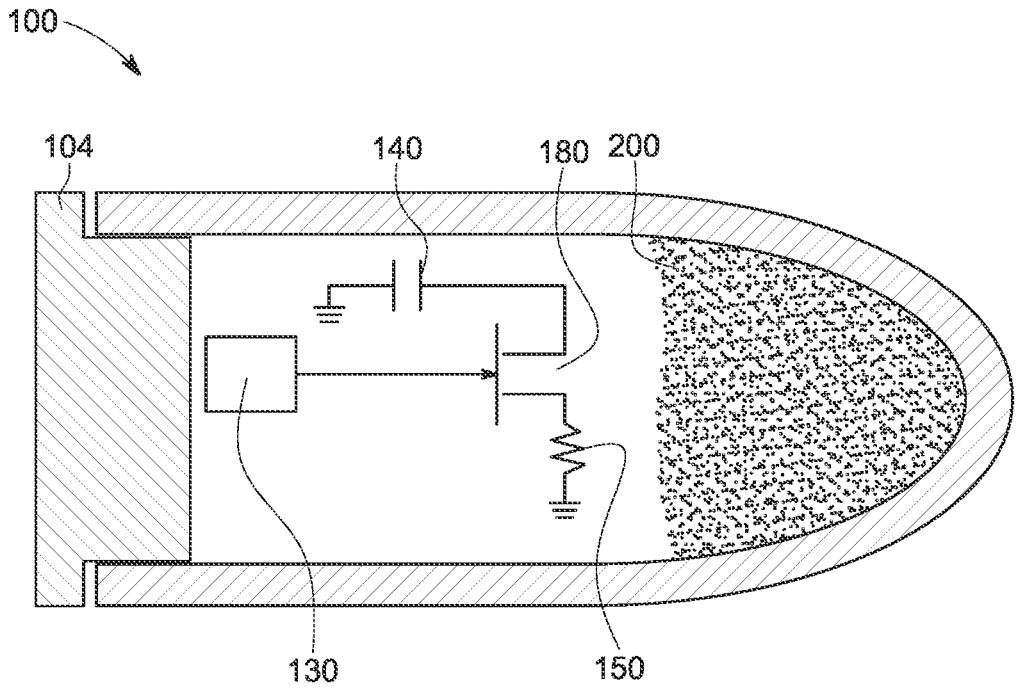
FIG. 4 is a view of a projectile comprising a payload, a control circuit, an initiator, and an energy storage means, in accordance with an exemplary embodiment of the present disclosure.

Referring to FIG. 4, the projectile 100 may further comprise an energy storage means 140 (such as, but not limited to, a capacitor or a miniature Lithium ion rechargeable battery) and an initiator 150 (such as, but not limited to, a heating element). As used herein, "energy storage means" is a storage means that lacks a sufficient charge to activate or arm the projectile or another component of the projectile until the energy storage means has been charged or energized by an outside source (such as a launcher, said launcher comprising an electrical, magnetic, and/or electromagnetic source) beyond a threshold energy. The charging of the energy storage means may also be referred to herein as "energizing" the energy storage means. The energy storage means disclosed herein may also be referred to as an energizable energy storage means. The energy storage means 140 and initiator 150 may be operatively coupled to a switch 180, and the timer 130 may cause the switch 180 to trip at a particular time after launch of the projectile 100, after which the energy storage means 140 may deliver stored energy to the initiator 150 to cause the initiator 150 to perform a reaction (such as heating) that results in the projectile 100 opening, separating or disintegrating to release the payload 200 In an embodiment, the energy storage means is energized by the at least one magnet 500 of the launcher and/or the at least one magnet 1500 of the launcher accessory coincident with launch of the projectile as described elsewhere herein.

Figure 5:
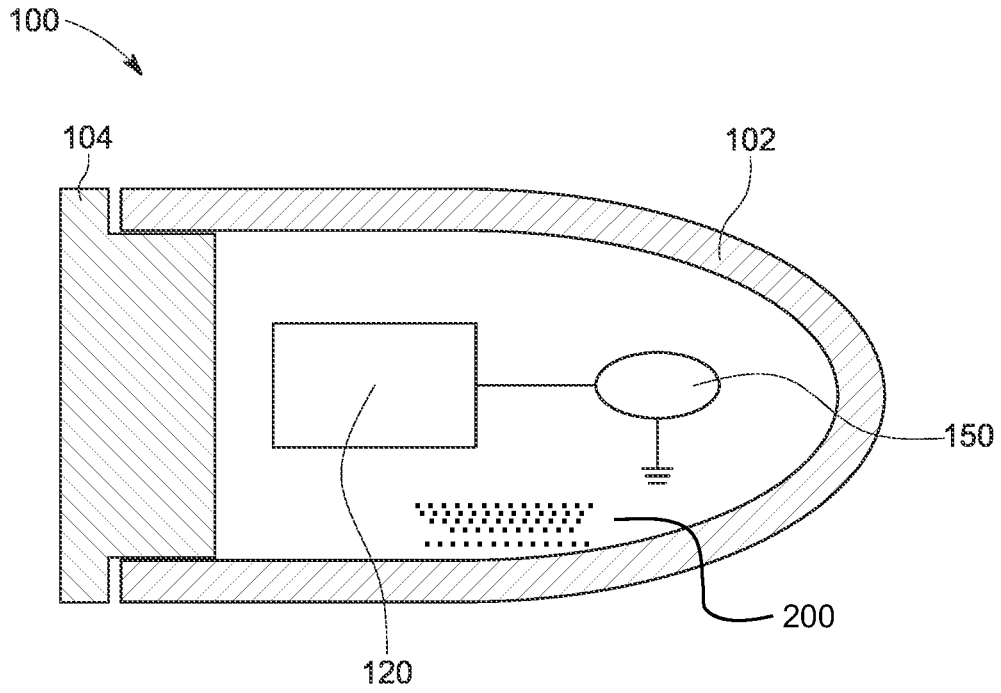
FIG. 5 is a view of a projectile comprising a payload, an initiator, and a control circuit, in accordance with an exemplary embodiment of the present disclosure.

In another embodiment, and referring to FIG. 5, the control circuit 120 is directly coupled to the initiator 150 such that the control circuit 120 permits operation by the initiator 150 after the initiator 150 or control circuit 120 has been activated by inductive energy from the coil 550 of the projectile 100. As shown in FIG. 5, the initiator 150 may be an electric match, which electric match may heat upon activation to create an opening in the shell of the projectile 100 to release the payload 200. It will be apparent that the control circuit may be activated by the at least one magnet 500 of the launcher and/or the at least one magnet 1500 of the launcher accessory. In said embodiment, the initiator will initiate opening of the projectile shortly after exiting the launcher. This would be desirable in a short-range situation, for example.

Figure 7:
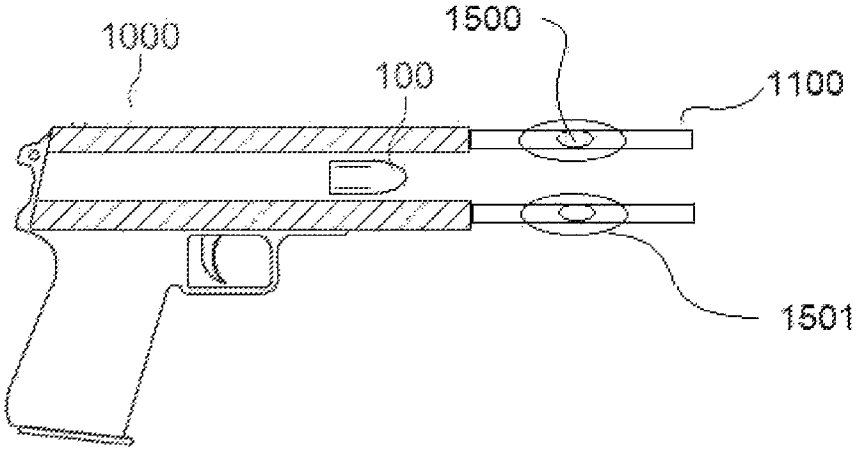
FIG. 7 shows a projectile, launcher and a launcher accessory, the accessory comprising at least one magnet which magnetic field lines are shown in accordance with an exemplary embodiment of the present disclosure.

Referring now to FIG. 7, a launcher accessory 1100 for a launcher is shown. The launcher accessory 1100 comprises at least one magnet 1500. The launcher accessory 1100 may be removably attached to a launcher (including, but not necessarily limited to launcher 1000). The accessory 1100 is preferably attached to a launcher such that the at least one magnet 1500 of the accessory 1100 is disposed in sufficient proximity to the launch axis of the launcher to facilitate launch of the projectile 100 and to engage the coil of wire 550 of the projectile 100 prior to or coincident with launch of the projectile. FIG. 7 also shows exemplary magnetic flux lines 1501 through which a projectile may pass and which may engage the coil of wire 550 of the projectile. In this exemplary embodiment, the magnetic flux 1501 is disposed along the launch axis of the accessory 1100 and is accordingly magnetically aligned with path of the projectile's launch. In an embodiment, the accessory 1100 is an elongated cylinder in shape, with a circumference that corresponds to the circumference of the barrel of the launcher to which the accessory 1100 is attached. Attachment of the accessory 1100 to the launcher 1000 may be by way of complementary engagement features, by a friction- or press-fit engagement, or by threaded connection, for example.

Figure 8:
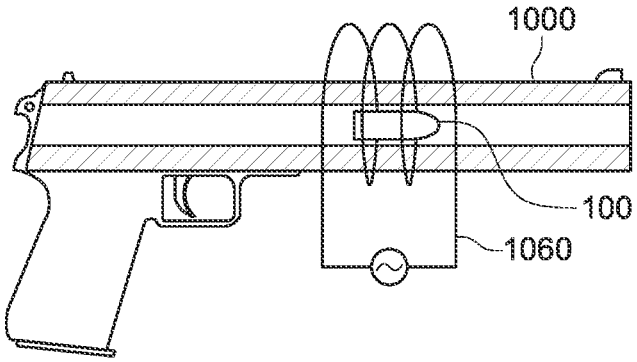
FIG. 8 shows a projectile and a launcher in which the projectile may communicate wirelessly with the launcher, in accordance with an exemplary embodiment of the present disclosure.
Figure 9:
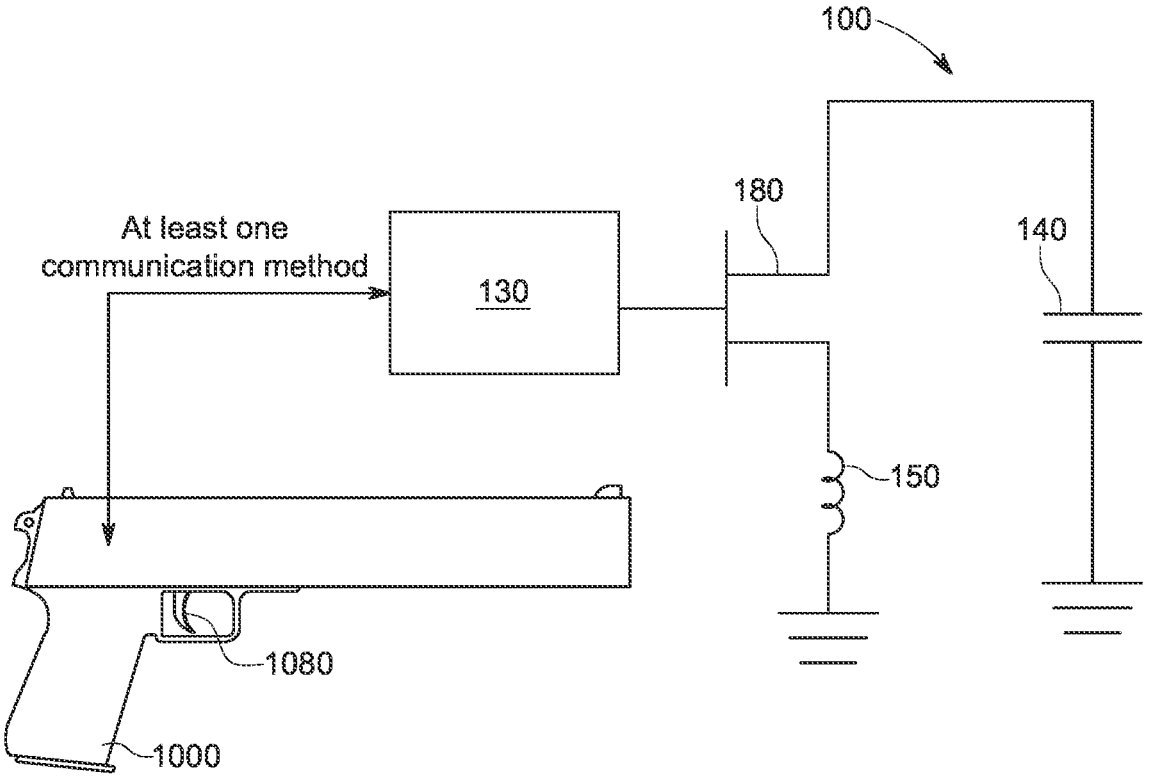
FIG. 9 shows a launcher, components of a projectile and at least one means of communicating information to the projectile, in accordance with an exemplary embodiment of the present disclosure.

In still another embodiment as shown in FIGS. 8 and 9 the projectile 100 and the launcher 1000 communicate through at least one of a wireless or wired means. This allows the launcher to set parameters within the projectile allowing for more precise control of the point at which the housing is breached or ruptured, i.e. to set a particular distance or time at which the projectile may rupture. The launcher accessory 1100 may comprise similar or the same such communication means as the launcher 1000 for communicating with the projectile 100. In a still further embodiment, the projectile has an energy storage means 140 which is activated or powered or energized by the launcher 1000 (for example, by means of at least one magnet 500 of the launcher acting upon the coil 550 of the projectile) and/or by the accessory 1100 (for example, by means of at least one magnet 1500 of the accessory acting upon the coil 550 of the projectile) and thus enhances the safety profile of the projectile 100, e.g., by keeping the projectile 100 and dispersal means inactive until it is at least chambered in the launcher. In a still further embodiment, the launcher 1000 and launch accessory 1100 include a means for measuring distance, such as a rangefinder, which means may communicate with the control circuit 120 and which means may permit in-situ customization of at least one parameter related to the burst or breach of the projectile 100, thus further increasing its ability to disperse the payload 200 at a more preferred or precise location.

As shown in FIG. 9, the launcher 1000 may comprise a trigger 1080 to initiate the launch process. It will be apparent that the charging of the energy storage means by the launcher and/or launcher accessory eliminates the requirement that the energy storage means comprise a self-contained power source (i.e., a battery for the energy storage means is not required), thereby eliminating the possibility that the energy storage means will suffer a power drain prior to launch. In an embodiment, the rangefinder is operatively coupled to an at least one electromagnet 500 of the launcher 1000 and/or an at least one magnet 1500 of the accessory 1100 such that the projectile 100 will be energized to a specific energy which corresponds to a particular distance (distance to the target, for example).

FIG. 1 represents a projectile launcher 1000 that is preferably based on electrical-driven or a combination of electrical and combustion or compressed gas means. It is understood that the projectile is not limited to a particular launching method but a preferable designed-launcher in which the advantages of having an electronic control and communication element with the projectile can be used. In an embodiment, the projectile herein is of lightweight construction (for at least the reason that it does not require an internal battery), such that compressed gas can sufficiently and effectively launch the projectile. However, the disclosure may, in other embodiments include, a primer and/or propellant on the projectile and a hammer of the launcher to strike such primer, as well as other means of launching the projectile other than by way of compressed gas. Because the projectile is energizable by the launcher (such as by the at least one magnet of the launcher) or other outside source, the possibility that the projectile would fail to operate due to draining of an internal battery is rendered moot.

The projectile, launcher, and launcher accessory disclosed herein offer the advantages of more controlled release of payload than existing solutions can offer. For instance, a user can set the range and/or rate at which the material is released by configuring parameters that control the opening in the projectile. The projectile further does not require impact upon a target. Configuration of the shell of the projectile disclosed herein may also increase accuracy of flight of the projectile to further improve the safety of use of the projectile disclosed herein. Furthermore, the projectile can be kept in an unarmed state until the projectile is launched from the launcher. The charging of the energy storage means by the launcher or other outside source eliminates the possibility that the projectile will suffer from power loss or failure prior to firing.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A projectile and launcher system, said launcher comprising a launch axis and at least one electromagnet and an adjustable power source, said projectile comprising a housing, a payload, a conductive wire coil, a control circuit and an energizable energy storage means, wherein the adjustable power source is coupled to the at least one electromagnet such that the magnetic field strength can be adjusted, wherein the adjustable power source comprises an alternating current signal, wherein the magnetic field strength is adjusted by varying at least one of the power and the frequency of an alternating current signal, wherein said at least electromagnet is magnetically aligned with said launch axis, wherein said energy storage means is at least partially energized by the at least one electromagnet, and wherein, alter launch of said projectile, said projectile housing ruptures, disintegrates, separates or otherwise has an opening created therein and releases said payload.

* * * * *